United States Patent [19]

Kirsch

[11] 4,079,937

[45] Mar. 21, 1978

[54] COMBINATION PIPE AND GAME

[76] Inventor: Daniel D. Kirsch, 2201 W. Belmont No. 3, Phoenix, Ariz. 85021

[21] Appl. No.: 712,939

[22] Filed: Aug. 9, 1976

[51] Int. Cl.[2] ..... A63F 7/06; A24F 3/00

[52] U.S. Cl. ..... 273/85 H; 46/44; 131/178; 273/95 C; 273/119 B; 124/62

[58] Field of Search ..... 273/85 H, 95 C, 119 B, 273/101; 131/178, 179; 46/44; 128/2.08; 124/62, 73; 272/27 B, 99

[56] References Cited

U.S. PATENT DOCUMENTS

| | | | |
|---|---|---|---|
| 943,472 | 12/1909 | Schreiber et al. | 124/62 X |
| 1,043,514 | 11/1912 | Drexler | 131/178 UX |

FOREIGN PATENT DOCUMENTS

| | | | |
|---|---|---|---|
| 13,777 of | 1898 | United Kingdom | 131/178 |

*Primary Examiner*—Anton O. Oechsle
*Attorney, Agent, or Firm*—Gregory J. Nelson

[57] ABSTRACT

A combination game and tobacco smoking device is disclosed. The device includes a base supporting a transparent air-tight chamber and a pipe bowl. A smoking tube communicates with both the pipe bowl and chamber to permit the user to draw smoke from the bowl and evacuate the air chamber. The air chamber contains a game-playing piece such as lightweight ball and a target or goal. An air passageway communicates the interior of the air chamber with atmosphere so the user can selectively admit air into the evacuated chamber to impart motion to the game piece to urge it toward the target or goal.

4 Claims, 10 Drawing Figures

COMBINATION PIPE AND GAME

The present invention relates to a smoking device and more particularly relates to a combination smoking device and game.

There are a number of various designs for pipes of various types for smoking tobacco products. However, few of the prior art design pipes provide smoking devices which incorporate a game so that the smoker can have the increased enjoyment of a game while smoking. A device of this general type is disclosed in my co-pending patent application entitled "PIPE", Ser. No. 688,581, filed May 21, 1976.

Briefly, the present invention comprehends a smoking device having a base which supports a chamber, preferably of clear plastic or other transparent material. A pipe bowl is secured to the device for containing appropriate tobacco material. A smoking tube, preferably transparent and flexible, communicates with the pipe bowl and with the interior of the chamber. A plurality of pipe tubes may be provided so that a number of individuals may participate in the game. An air inlet communicates with the interior of the air chamber and is valved to control the admission of atmospheric air into the chamber. By drawing or by application of suction on the smoke tube, the smoker can inhale tobacco smoke from the pipe bowl and also evacuate the air chamber. A lightweight game piece such as a ball is contained within the air chamber. The object of the game is for a smoker to draw smoke from the pipe bowl through the tube and at the same time evacuate the air chamber. At some point in the game, the player can selectively actuate the air valve, causing an inflow of atmospheric air into the chamber. This flow of air will elevate or move the lightweight ball within the chamber. In other variations, the ball is urged along a playing field simulating a soccer field or other type of game.

The above and other objects and advantages of the present invention will become apparent from the following description, claims and drawings in which:

Figure 1:
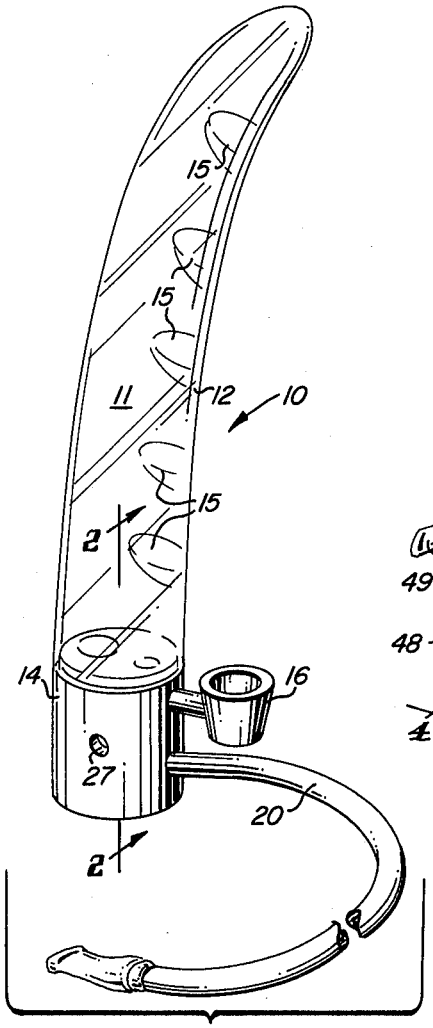
FIG. 1 is a perspective view of one embodiment of the combination smoking device and game of the present invention.
Figure 2:
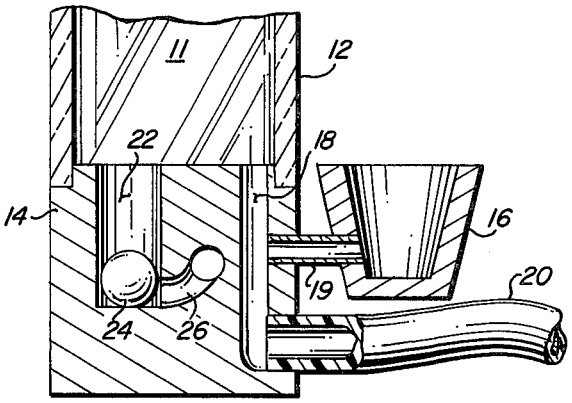
FIG. 2 is a partial sectional view illustrating the details of the device shown in FIG. 1.

Turning now to the drawings, particularly FIGS. 1 and 2, the combination smoking device and game is generally designated by the numeral 10. The device 10 includes an elongate generally cylindrical housing 12 which defines an interior chamber 11. Circular goals or baskets 15 are vertically spaced within chamber 11. Housing member 12 is mounted on an appropriate base member 14. Base member 14 supports conventional receptacle or pipe bowl 16. A passageway 18 extends through the base and communicates with air chamber 11. Pipe bowl 16 also is in communication with passage 18 via tube 19. The lower end of passage 18 connects to flexible tube 20 which terminates at an appropriate stem or mouthpiece. The smoker can draw smoke from pipe bowl 16 via tube 19, the lower portion of passageway 18 and tube 20. It will be obvious that by applying suction at tube 20, air will also be withdrawn from air chamber 11.

A recess 22 is provided in base 14 opening into air chamber 11. A lightweight game piece such as a ball 24 seats within recess 22. The lower end of recess 22 communicates with atmosphere passage 26 opening at aperture 27 in base 14 which serves as an air valve.

A more complete understanding of the present invention will become apparent from the following description of use of the embodiment of FIGS. 1 and 2. The user packs the pipe bowl 16 with an appropriate tobacco material and ignites the material while drawing air through the pipe bowl through tube 20. Suction applied at tube 20 will also cause air to be withdrawn from air chamber 11. Opening 27 at the terminal end of passageway 26 is closed off by the user placing his finger over the opening. Continued smoking will result in partial evacuation of air chamber 11. When chamber 11 is partially evacuated, the smoker removes his finger from opening 27 permitting atmospheric air to flow through passage 26 and through recess 24 into chamber 11. The incoming air will elevate or move the ball 24 upwardly within the tube or housing 12. Points are scored by elevation of lightweight ball 24 into one of the baskets 15 vertically arranged in tubular housing 12. The baskets 15 at the higher elevation yield numerically higher scores if the ball passes through one of the baskets.

Figure 3:
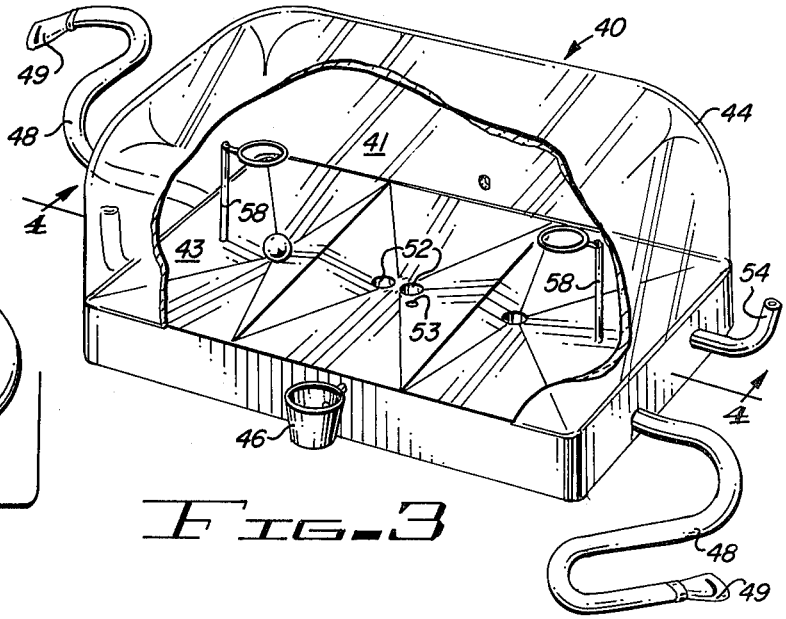
FIG. 3 is a perspective view of another embodiment of the combination game and smoking device of the present invention.
Figure 4:
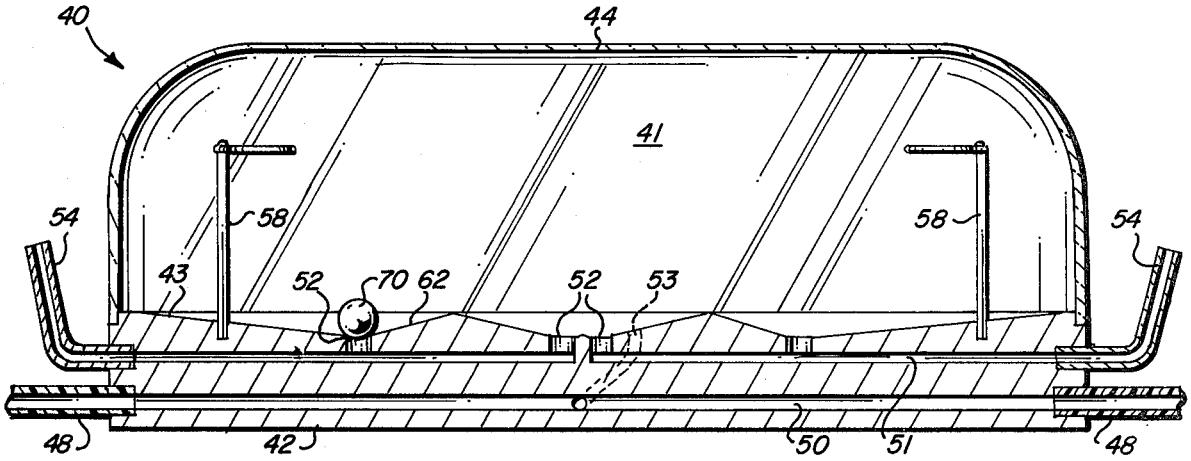
FIG. 4 is a longitudinal sectional view of the device of FIG. 3 taken along lines 4—4 of FIG. 3.

FIGS. 3 and 4 show another form of the present invention which is generally designated by the numeral 40. This embodiment includes a generally rectangular base 42 having an upper surface 43 defining a playing surface or playing field. The playing field 43 is enclosed within a dome-like housing 44 which is preferably transparent and defines interior chamber 41. A tobacco receptacle or pipe bowl 46 is secured to base 42 at an appropriate location and is shown extending from one of the longitudinal sides of the base 42. The interior of the pipe communicates with a longitudinal passage 50 which extends through the base 42 and communicates with chamber 41 through passage 53. The opposite ends of the passage 50 are connected to tubes 48 each terminating at the appropriate mouthpiece 49. Tubes 48 are for use by the smoker in drawing smoke from the pipe bowl 46. A second passage 51 extends through base 42 and opens at selected locations 52 into the interior of the chamber 41. Extensions 54 which serve as air valves project at either end of the base 42. Baskets or goals 58 are disposed at opposite ends of the playing field or area 43. The playing surface 43 is provided with concavities 62 which permit a ball or game piece 70 to seat over air inlets 52.

In use, embodiment 40 is similar to the device shown in FIGS. 1 and 2. Smokers located at either end of the device place mouthpiece 49 in their mouth and draw through tubes 48 causing smoke to be drawn from pipe bowl 46. The suction induced by the smokers also serves to evacuate chamber 41 by drawing air through passageway 53. The ends of tubes 54 are closed off by the users placing a finger over the tube openings. Once chamber 41 is partially evacuated, one of the players releases his finger at the tube 54 controlled by him. Release will permit atmospheric air to flow through passageway 51 and openings 52 into chamber 41. This flow of air will elevate or move the ball 70 which in a normal position would be resting in one of the concavities 62. The ball is caused to be ejected from its location and in the event the ball is moved into or through the goal 58, the appropriate player receives a point or score. It will be obvious that the device shown in FIGS. 2 and 3 can be adapted for use by one, two or a plurality of players.

Figure 5:
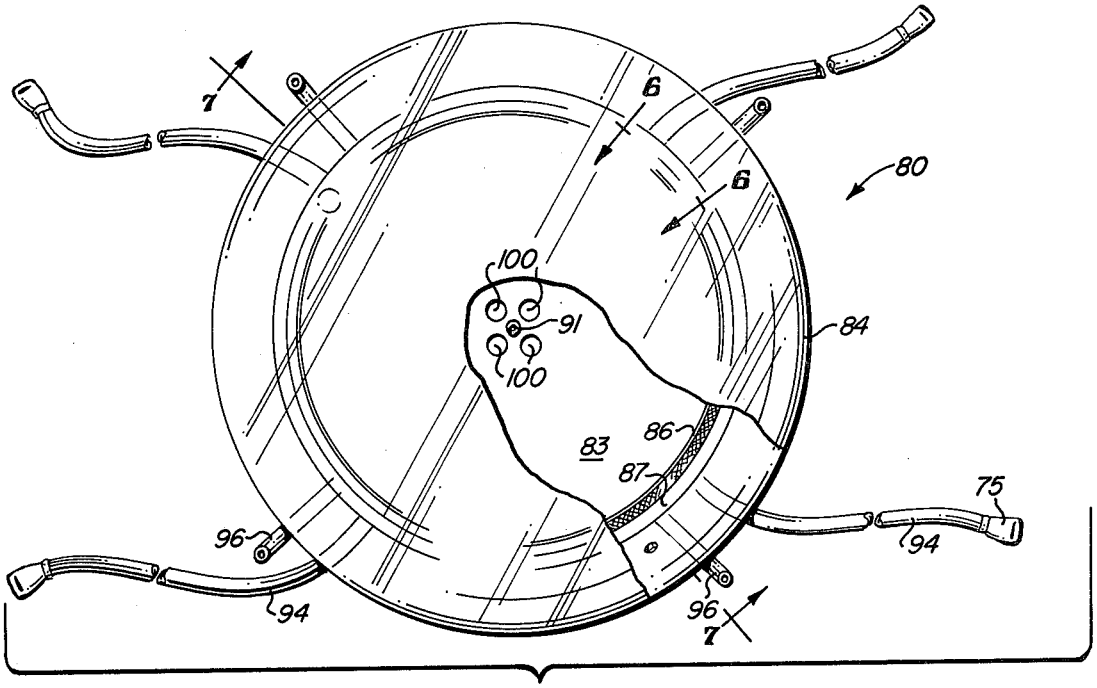
FIG. 5 is a plan view of another embodiment of the present invention.
Figure 6:
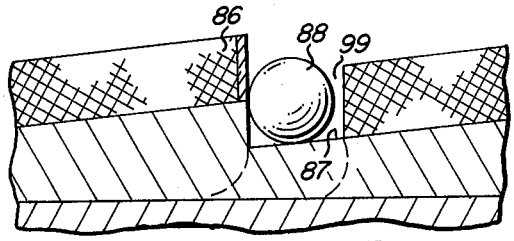
FIG. 6 is a sectional view taken along lines 6—6 of FIG. 5.
Figure 7:
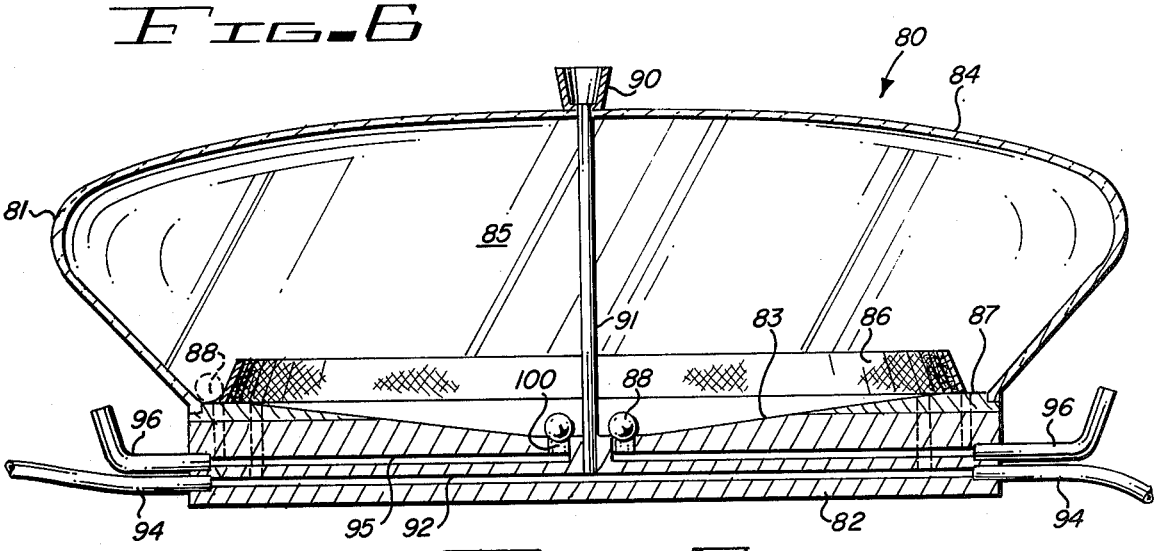
FIG. 7 is a sectional view of the combination smoking device and game shown in FIG. 4 taken alone lines 7—7 of that Figure.

FIGS. 5 to 7 show still another embodiment of the present invention which is generally designated by the numeral 80. The device shown in this embodiment includes a circular base 82 having an upper surface 83 which defines a playing area. A transparent dome 84 covers the base 82 and defines an interior chamber 85. The cover 84 is preferably eliptical having annulus 81 projecting beyond the base 82. A net 86 extends peripherally around the playing surface at an approximate location corresponding to the peripheral edge of base 82. An annular track 87 extends in the peripheral area between the net 86 and the edge of the dome. The track 87 is, inclined as seen in FIG. 6, so that lightweight balls 88 will under the effect of gravity normally return to a position on the playing surface 83 from the track 87 at opening 99.

Conventional tobacco receptacle or pipe bowl 90 is shown centrally mounted on the top of dome 84. A vertical smoke tube 91 communicates with the interior of pipe bowl 90 at its upper end and with radial smoke passages 92 at its lower end. Each of the smoke passages 92 is connected to a tube 94 having a mouthpiece 75, four being shown for purposes of illustration. Four radial air passageways 95 terminate at openings 100 near the center of the base within chamber 86. The outer radial ends of air passageways 95 are connected to extensions 96 which serve as air valves to "trigger" the balls 88.

An opening 99 is provided in peripheral net 81 so that balls returning around the peripheral track will be permitted to return to the playing surface 83. Note the playing surface is slightly concave and the gravity will also cause the balls to assume a position near the center of the playing area resting above air holes 100 which communicate with air passages 95.

The use of the device shown in embodiment 80 is substantially the same as has been described above. The smokers simultaneously withdraw smoke from bowl 90 and also simultaneously evacuate chamber 85 by tubes 94. The extensions 96 are closed off as chamber 85 is partially evacuated. One or more of the players then releases a finger from the end of one of the tubes 96 causing atmospheric air to be admitted into the associated tube 95 ejecting one of the balls 100. The object of the game is to cause the balls 100 to be catapulted over the net 86 onto the peripheral track 87. Balls will return to play by rolling along the track and returning to the inner surface of the playing area at the openings 99 in the net.

Figures 8, 9, 10:
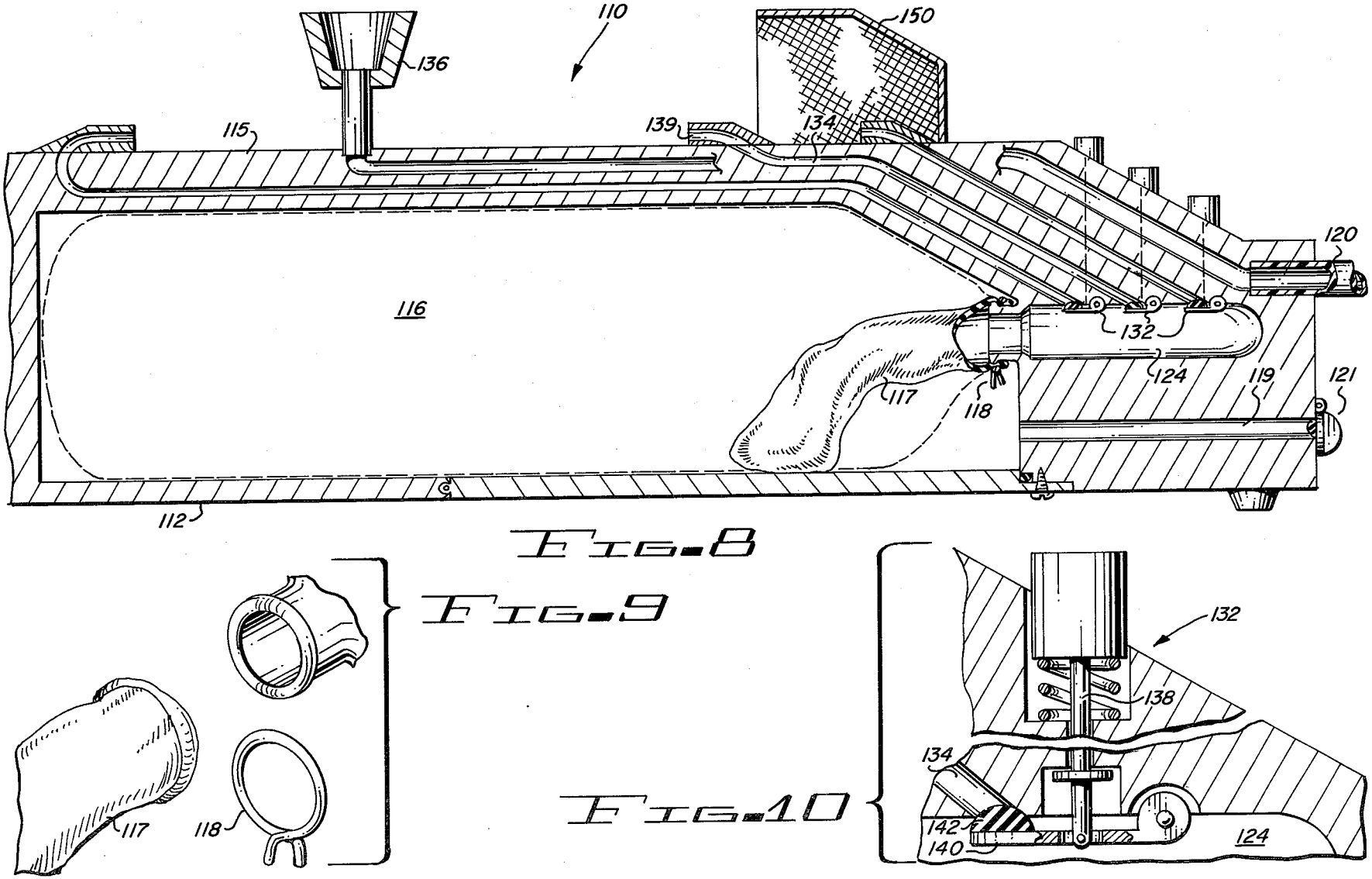
FIG. 8 is a partial sectional view illustrating another form of the invention in which an inflatable air chamber is utilized as a source of air pressure.
FIG. 9 is an exploded view showing the attachment of the inflatable air chamber used in the embodiment shown in FIG. 8.
FIG. 10 is a detail view illustrating the construction of the air valve of the embodiment of FIG. 8.

FIG. 8 is a sectional view illustrating still another form of the device in which suction applied by the smoker induces inflation of an appropriate flexible air chamber such as a balloon. In this embodiment, generally designated by the numeral 110, one-half of the combination game and smoking device is shown in sectional elevation. The device includes a base 112 defining a playing surface 115 on its upper surface. A chamber 116 is formed within the base and houses an expandable flexible bladder member 117. Chamber 116 communicates with atmosphere through passage 119 and valve 121. A smoke tube 120 communicates with chamber 116 and also with pipe bowl or tobacco receptacle 136 appropriately secured to base 112. A plurality of air tubes 134 connect manifold 124 with air discharge jets 139 strategically placed at locations on playing surface 115. Valves 132 control release of air into air tubes 134. As best seen in FIG. 10, each of the valves 132 includes spring loaded plunger 138 which actuates a flap valve element 140. Flap 140 carries seat 142 which seals off the end of tube 134. Appropriate goal 150 is located at either end of the playing surface 115.

To use the present embodiment, opposed players each fill their respective pipe bowl 136 with tobacco material. The mouthpiece of tube 120 is inserted in the smoker's mouth. Smoke is withdrawn from pipe bowl 136 through tube 120. The suction induced by the smoker also serves to evacuate chamber 116. When chamber 116 is evacuated, atmospheric air is introduced into bladder 117 by opening one of the valves 132. The bladder 117 will expand filling chamber 115. When this occurs, a player can selectively admit air into chamber 116 by opening valve 121 and by actuating one of the valves 132 releasing jets of air at selected locations 139 on the playing surface. The jets of air are utilized to advance a lightweight ball toward the opponent's goal.

The foregoing embodiment differs from preceding embodiments in that suction is used to inflate a bladder which is used as a source of air pressure. It will be apparent that a diaphragm could be used in place of the bladder to achieve the same functional results.

As is seen from the foregoing, the present invention provides a novel and unique combination smoking and game device. The device utilizes the suction induced by the smoker to actuate a game piece or ball. The particular form of the game may be modeled after a number of games or sports such as tennis, soccer, basketball and the like. The present invention provides the oral and visual satisfaction associated with smoking tobacco material along with the added interest of a competitive game. The various embodiments described herein can be adapted for use by one or a number of players. Targets can also be included for added interest.

It will be obvious to those skilled in the art to make various changes, modifications and alterations to the embodiments herein described. To the extent that these changes, modifications and alterations to not depart from the spirit and scope of the appended claims, they are intended to be encompassed therein.

I claim:

1. A combination game and smoking device comprising:

(a) a base member defining a surface for receiving a playing piece;

(b) a bowl for receiving smoking materials;

(c) means defining a chamber with said surface within said chamber;

(d) evacuating means in communication with said chamber and said pipe bowl for drawing smoke from said bowl and withdrawing air from said chamber to establish pressure differential between said chamber and an area of higher pressure; and (e) air means independent of said evacuating means responsive to said pressure differential to selectively direct a flow of air to said playing surface to actuate said playing piece in said chamber.

2. A combination game and smoking device comprising:

(a) a base member defining a playing surface having at least one game piece receivable thereon;

(b) a receptacle for receiving a smoking material;

(c) an airtight chamber, said playing surface being within said chamber;

(d) evacuating means in communication with the interior of said chamber and with said receptacle for drawing smoke from said receptacle and air from said chamber; and (e) at least one air passageway communicating with said chamber at a location along said playing surface and communicating with atmosphere whereby said passageway can be selectively placed in atmospheric communication by the player inducing a flow of air into said chamber to impart motion to said game piece.

3. The device of claim 2, wherein said game piece is a lightweight ball and said chamber includes one or more target members.

4. The device of claim 2, wherein said game piece comprises a plurality of balls and said device includes multiple evacuating means and multiple air passageways for use by a plurality of players.

* * * * *